US009968136B1

(12) United States Patent
Bell

(10) Patent No.: US 9,968,136 B1
(45) Date of Patent: May 15, 2018

(54) HEATER ELEMENT FOR A VAPORIZATION DEVICE

(71) Applicant: Funai Electric Co., Ltd., Osaka (JP)

(72) Inventor: Byron V. Bell, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days. days.

(21) Appl. No.: 15/350,168

(22) Filed: Nov. 14, 2016

(51) Int. Cl.
*A24F 17/00* (2006.01)
*A24F 47/00* (2006.01)
*H05B 3/12* (2006.01)

(52) U.S. Cl.
CPC ..... *A24F 47/008* (2013.01); *H05B 3/12* (2013.01); *H05B 2203/021* (2013.01)

(58) Field of Classification Search
CPC ..... A24F 47/008
USPC ..... 131/328–329, 173–290
See application file for complete search history.

(56) References Cited

U.S. PATENT DOCUMENTS

2015/0217068 A1* 8/2015 Wakalopulos ..... A61M 15/06 128/202.21
2016/0100633 A1* 4/2016 Gao ..... A24F 47/008 131/329
2017/0105449 A1* 4/2017 Hearn ..... A24F 47/008

OTHER PUBLICATIONS

Brooks, D.; Selvy, A, "A high dielectric constant lets these heating modules be compact and heat up quickly," Basics of Ceramic Heaters, Aug. 28, 2013, pp. 1-3.
"Evaporation Boats," Midwest Tungsten Service, Web Page, pp. 1-7, Aug. 11, 2016.

* cited by examiner

*Primary Examiner* — Phuong Dinh
(74) *Attorney, Agent, or Firm* — Luedeka Neely Group, PC

(57) ABSTRACT

A heater element for a vaporizing device, a vaporizing device containing the heater element, and a method for vaporizing fluid ejected by an ejection head. The heater element includes a conductive material having a concave area. The concave area of the heater element captures and vaporizes fluid ejected from an ejection head in the vaporization device. The concave area of the heating element has a cavity volume that is at least sufficient to retain an entire volume of liquid to be vaporized.

17 Claims, 4 Drawing Sheets

HEATER ELEMENT FOR A VAPORIZATION DEVICE

TECHNICAL FIELD

One of the applications of a fluidic ejection device is to jet a solution on to another device where a secondary function may be performed. A common secondary function is to vaporize a solution using a heater such that the contents of the solution can be vaporized so as to deliver the solution as a gaseous substance. Applications of such technology include, but are not limited to, metering and vaporizing device for electronic cigarettes, vapor therapy, gaseous pharmaceutical delivery, vapor phase reactions for micro-labs, and the like. A problem associated with such devices is efficient vaporization of the fluid. This document discloses improved heater elements and methods for improving the vaporization efficiency of heater elements for vaporization devices.

BACKGROUND AND SUMMARY

When jetting a fluid onto a heated surface it is highly desirable for 100% of the fluid to vaporize so that liquid is not discharged from the vaporizing device. The problem lies in that the vaporizing heater must be small enough to heat up extremely quickly, yet has enough surface area to catch all fluid and fluid droplets that are being ejected onto the heater element. A simple planar heater loses efficiency due to the margins of the heater not being wetted by the impinging fluid ejected onto the heater. Accordingly, the heater must be made somewhat oversize to compensate for any spread or misdirection in the fluid stream ejected onto the heater. Unused heater surface degrades heater efficiency by radiation/convection heat loss to the surrounding environment. Accordingly, what is needed is a heater element of minimum size that will capture 100% of the ejected fluid stream, and will also have minimal un-wetted surface area. A heater element having a minimum mass is desirable in order to reduce the amount of energy required to raise the heater element to its operating temperature.

Rapid heating of the heater element is also essential to assuring that all of the liquid ejected onto the heater element is vaporized. Complete vaporization of the fluid is important in order to avoid entraining liquid droplets in the vapor stream from the vaporization device. In some applications, the discharge of liquid is not only undesirable, but may be detrimental to the user. In order to avoid the discharge of liquid droplets from a vaporization device, the stream of fluid ejected onto the surface of the heater element must be efficiently captured by the heater element, and completely vaporized at approximately the same rate as the fluid arrives on the surface of the heater element.

In view of the foregoing, embodiments of the disclosure provide a heater element for a vaporizing device, a vaporizing device containing the heater element, and a method for vaporizing fluid ejected by an ejection head. The heater element includes a conductive material having a concave area, wherein the concave area of the heater element captures and vaporizes fluid ejected from an ejection head in the vaporization device. The concave area of the heating element has a cavity volume that is at least sufficient to retain an entire volume of liquid to be vaporized.

Another embodiment of the disclosure provides a vaporization device that includes a housing body, a mouthpiece attached to the housing body, and a heater element disposed adjacent to the mouthpiece for vaporizing fluid ejected from an ejection head onto the heater element. The heater element includes a conductive material having a concave area, wherein the concave area of the heater element captures and vaporizes fluid ejected from the ejection head in the vaporization device. The concave area of the heating element has a cavity volume that is at least sufficient to retain an entire volume of liquid to be vaporized.

A further embodiment of the disclosure provides a method for vaporizing a fluid ejected by an ejection head so that substantially all of the fluid ejected by the ejection head is vaporized. The method includes providing a vaporization device having an ejection head and a vaporizing heater element adjacent to the ejection head. Fluid is ejected by the ejection head onto the heater element. The heater element is activated during fluid ejection in order to vaporizes substantially all of the fluid ejected onto the heater element. The heater element includes a conductive material having a concave area, wherein a concave area of the heater element captures and vaporizes fluid ejected from the ejection head in the vaporization device. The concave area of the heating element has a cavity volume that is at least sufficient to retain an entire volume of liquid to be vaporized.

In some embodiments, the concave area of the heater element is provided by an open-ended hexahedral-shaped heater element.

In another embodiment, the concave area of the heater element is provided by a dimpled heater element.

In yet another embodiment, the concave area of the heater element is provided by a conical heater element.

In some embodiments, the concave area of the heater element has a volume ranging from about 0.2 cubic centimeters (cc) to about 5 cc.

BRIEF DESCRIPTION OF THE DRAWINGS

Other features and advantages of disclosed embodiments may be evident by reference to the following detailed description, drawings and claims wherein:

DETAILED DESCRIPTION OF EMBODIMENTS

Figure 1:
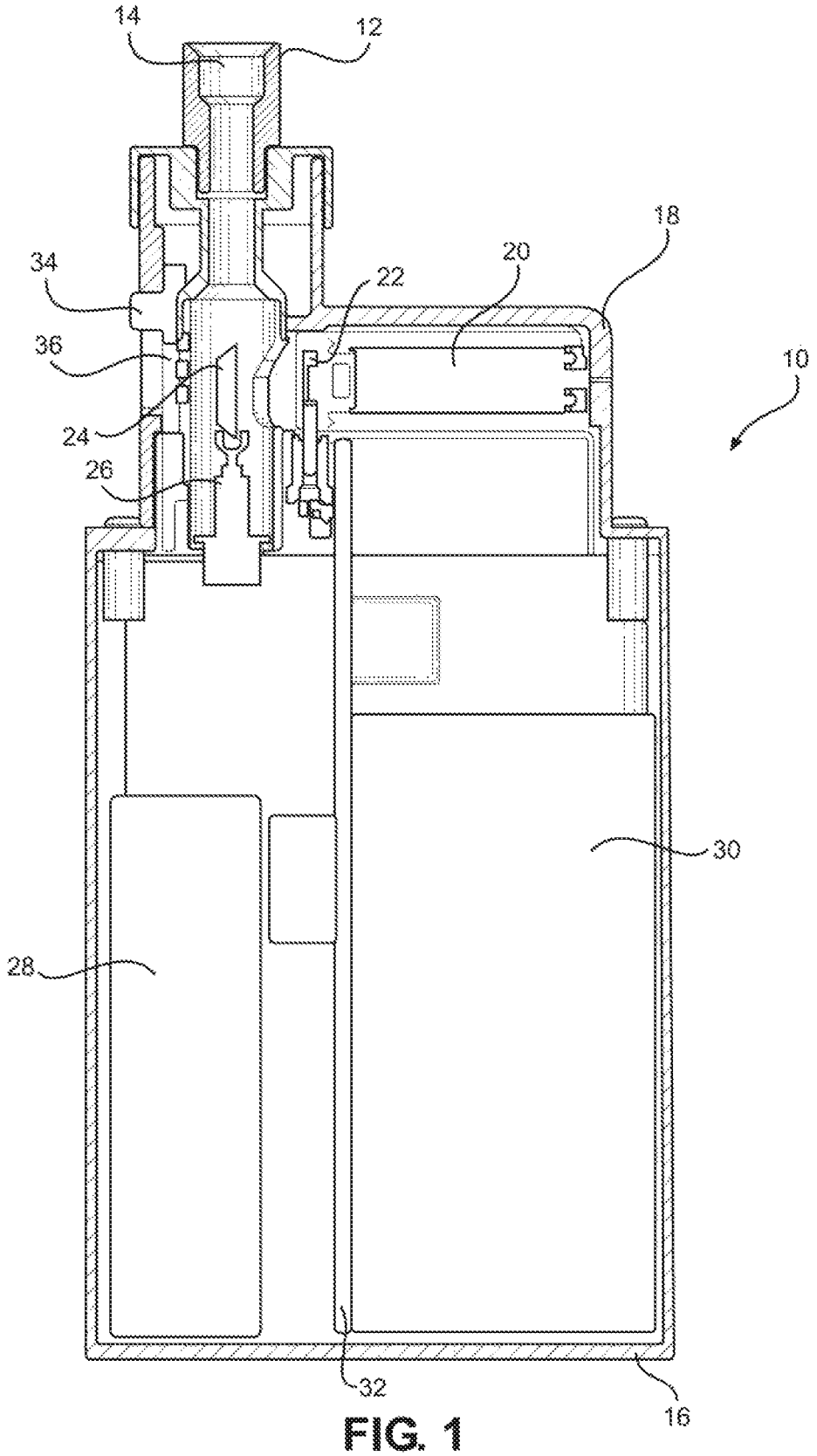
FIG. 1 is a cross-sectional view, not to scale, of a vaporization device according to an embodiment of the disclosure.
Figure 2:
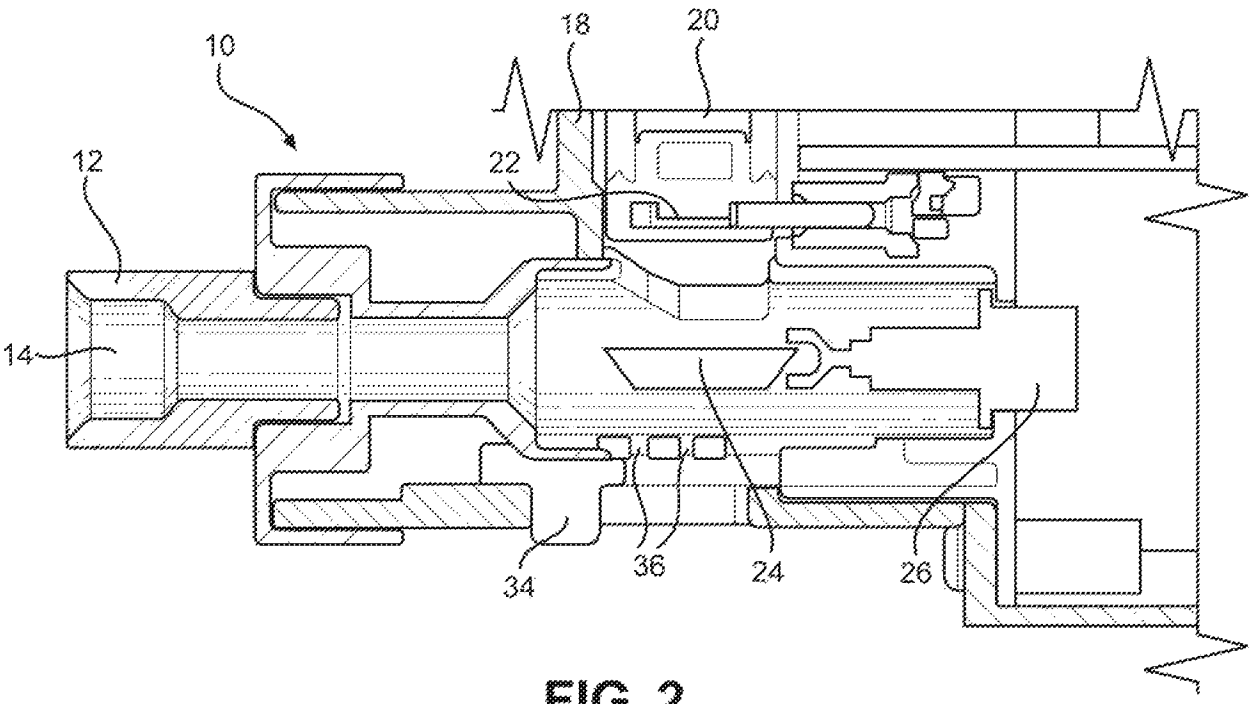
FIG. 2 is a close-up view, not to scale, of a portion of the vaporization device of FIG. 1.

The disclosure is directed to a vaporization device 10 as shown in FIGS. 1 and 2 and heater elements therefor as shown in FIGS. 3-8. Such devices 10 may be used for a wide variety of applications wherein a liquid is ejected onto a heater element to provide a vapor stream as described in more detail below. Such devices 10 are typically hand held devices such as electronic cigarettes that have a mouthpiece 12 for inhaling vapors generated by the device 10. The mouthpiece 12 includes a conduit 14 for flow of vapors out of the device 10. The main components of the device 10 include a housing body 16, a removable cartridge cover 18, a removable fluid supply cartridge 20, an ejection head 22 associated with the fluid supply cartridge 20, and a heater element 24 for vaporizing fluid ejected from the ejection head 22 and a holder 26 providing electrical connections for the heating element 24. Other components associated with the vaporization device 10 include a rechargeable power supply 28, a main circuit board 30, and a vaporization driver card 32. An enlarged portion of the vaporization device is shown in FIG. 2.

The mouthpiece 12, as well as the body 16 of the vaporization device 10 may be made from a wide variety of materials including plastics, metals, glass, ceramic and the like provided the materials are compatible with the fluids to be ejected and vaporized by the device 10. A particularly suitable material may be selected from polyvinyl chloride, high density polyethylene, polycarbonate, stainless steel, surgical steel, nickel-plated steel, and the like. All parts, including the mouthpiece 12, and body 16 that come in contact with fluids and vapors may be made of plastic. The conduit 14 may be made of metal such as stainless steel or other material that is resistant to heat and vapors generated by the device.

As shown in FIG. 1, the housing body 16 may include the circuit board 30 and the driver card 32 for providing the logic circuitry for the heater element 24 (described in more detail below) and ejection head 22. The rechargeable battery 28 may also be housed in the housing body 16. In another embodiment, a removable, non-rechargeable battery may be housed in the housing body. Electrical contacts, such as a USB (not shown) may be used to recharge the battery 28 and to change program setting for the ejection head 22 and heater element 24. The microfluidic ejection head 22 is in fluid flow communication with the fluid supply cartridge 20 that provides fluid to be ejected by the ejection head 22.

An inlet air flow control device may be included to provide backpressure control on the ejection head 22. The inlet air flow control device may include a damper slide 34 and air inlet holes 36 that allow air to be drawn into the conduit 14 adjacent the heater element 24 and ejection head 22 so that excessive negative pressure on the ejection head 22 can be avoided.

Figure 3:
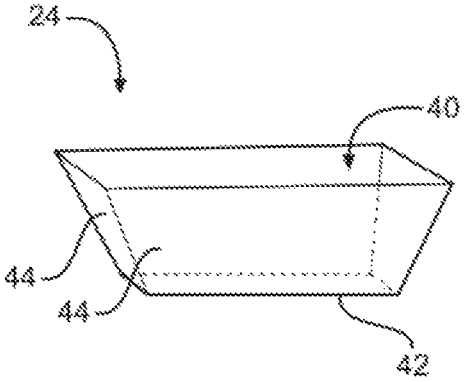
FIG. 3 is a two-dimensional view, not to scale, of an open-ended hexahedral-shaped heater element according to a first embodiment of the disclosure.
Figure 4A:
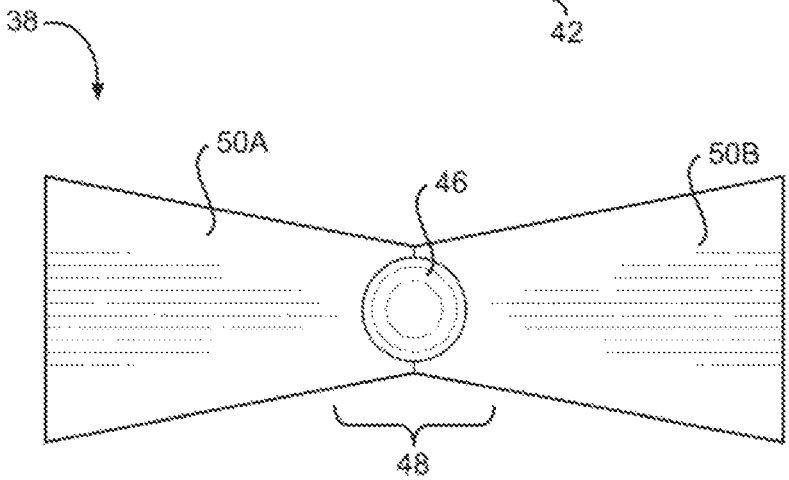
FIG. 4A is a plan view, not to scale, of a dimpled heater element according to a second embodiment of the disclosure.
Figure 4B:
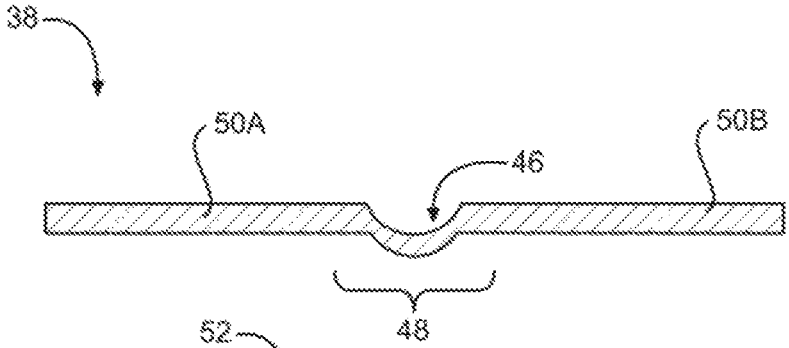
FIG. 4B is a cross-sectional view, not to scale, of the heater element of FIG. 4A.
Figure 5:
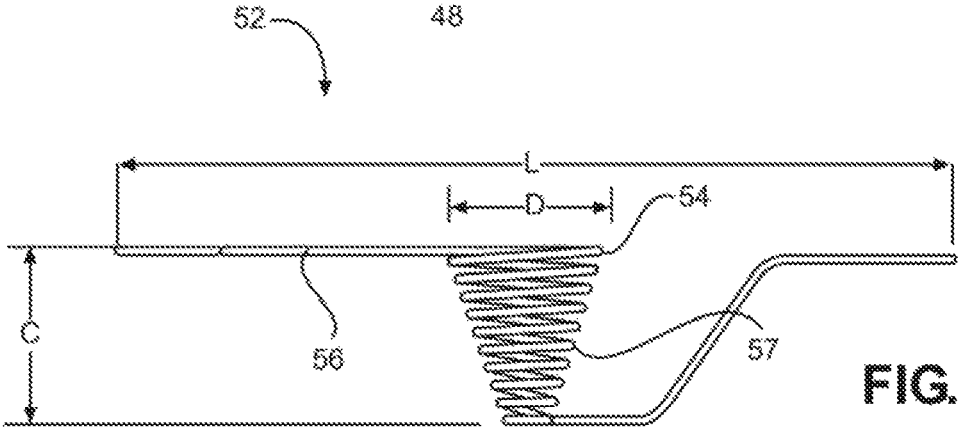
FIG. 5 is a two-dimensional view, not to scale, of a heater element according to a third embodiment of the disclosure.
Figure 6:
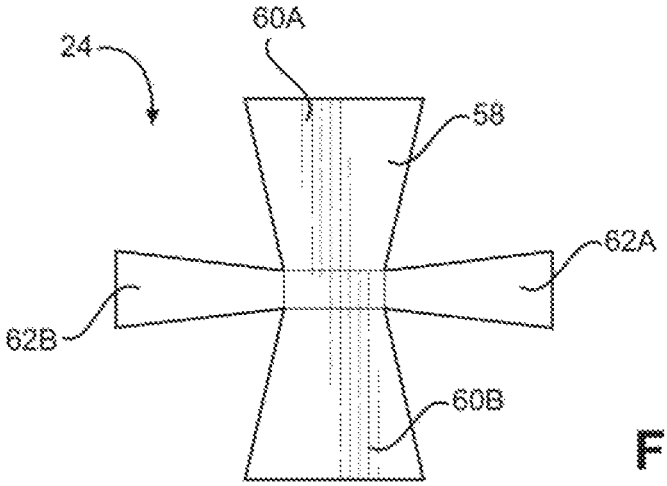
FIGS. 6-9 are schematic illustrations of a method for making an open-ended hexahedral-shaped heater element according to the first embodiment of the disclosure.
Figure 7:
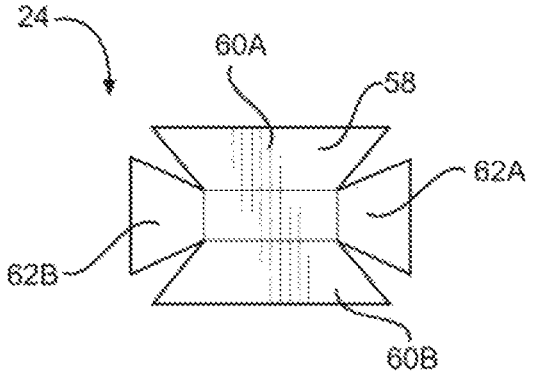
Figure 8:
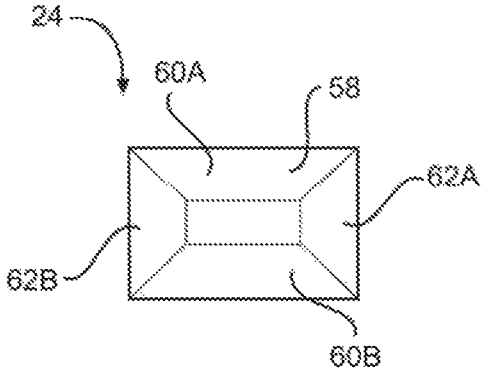
Figure 9:
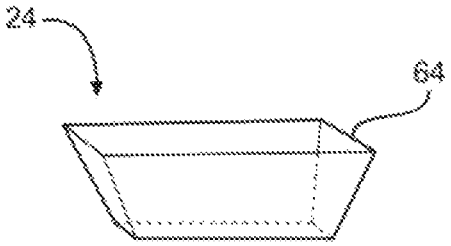

An important component of the vaporization device 10 is the heater element. Exemplary heater elements are shown in FIGS. 3-5. The heater elements 24 and 38 may be made from metal foil materials or other metal materials that may be readily cut, folded, and or dimpled. Metals suitable for making the heater elements 24 (FIG. 3) and 38 (FIGS. 4A and 4B) include, but are not limited to, tantalum, nickel alloys, aluminum alloys, copper alloys, tungsten, and the like. The metal selected for the heater elements 24 and 38 are suitably those metals that are resistant to corrosion in high temperature applications in contact with the fluids being vaporized.

Heater element 24 is an open-ended hexahedral-shaped heater element that provides a concave area or cavity 40 for fluid ejected from the ejection head 22. Accordingly, fluid ejected into the cavity 40 of the heater element 24 may be contained and heated to the vaporization temperature of the fluid. The heating element 24 not only provides vaporization heat to the fluid by the bottom wall 42 thereof, but the side-walls 44 also contact and heat the fluid to the vaporization temperature.

The heater element 38 (FIGS. 4A and 4B) has one or more concave areas or dimples 46 that are disposed in a central area 48 thereof between opposing conductor sections 50A and 50B. The concave areas or dimples 46 may be made by deforming a metal foil material to a depth sufficient to form a cavity for fluid. The conductor sections 50A and 50B may be significantly wider than the central area 48 in order to concentrate current density in the concave areas or dimples 46 where such heat is needed for vaporization of the fluid. The current density is concentrated in the central area by providing a width of the conductor sections 50A and 50B that may range from about 50% to about 100% greater than a diameter of the concave area 46. In terms of wetted heater area, the cavity volume should be at least sufficient to retain the volume of liquid to be vaporized. For example, if a dose of liquid to be vaporized is 10 mg, the volume of the concave area should be about 10 $mm^3$. The "wetted heater area" is the entire heating area of the heater element 24, excluding any heater trace connections.

In a further embodiment of the disclosure, the heater element is a conical-shaped heater element 52 having a heater element length L of from about 1 centimeter (cm) to about 2.5 cm, a maximum coil diameter ranging from about 0.5 to about 2 cm, and a coil height C ranging from about 6 millimeters (mm) to about 25.4 mm. The heater element 52 may be provided by a coated wire coils 54 wherein the coating is sufficient to eliminate gaps between adjacent coil wires. The coating on the wire coils 54 may be selected from a catophoretic ceramic insulating material of minimum thickness sufficient to bridge adjacent turns of the wire coils 54 and thus provide a rigid structure with no gaps in the conical-shaped heating element 52.

As illustrated schematically in FIGS. 6-9, the heater element 24 may be made by assembly of a folded metal foil 58 into the shape of the open-ended hexahedral shaped heater element 24 in such a manner as to have no gaps between individual elements. The foil 58 is desirably selected from a material having a minimum mass to thickness ratio so as to reduce the warm up time and energy consumption, determined as a function of the rate of vaporization required.

The edges of the folded metal foil 58 may not need to be welded or otherwise joined together if sides 60A and 60B perpendicular to sides 62A and 62B are folded inside the edge walls of sides 62A and 62B to help capture all of the ejected fluid. Electrical leads (not shown) may be attached to sides 62A and 62B adjacent an upper rim 64 of the heater element 24.

The reduction in cross sectional area toward the bottom wall 42 of the heater element 24 may result in increased heat at the bottom of the heater element 24 where such heat is needed to vaporize the ejected fluid.

In any embodiment, the back side of the heater element (not exposed to the fluid ejected from the ejection head 22 may be shielded to reduce thermal heat losses from radiation.

An advantage of the disclosed embodiments is that substantially all of the fluid ejected from the ejection head 22 is captured and exposed to a surface of a heater element hot enough to cause immediate vaporization of the jetted fluid. The mass of the heater element may be tuned for optimal heater warm up and vaporization efficiency based on the rate of vaporization required. The voltage/current requirements for driving the heater element may likewise be tuned by adjusting the material thickness, composition and shape of the heater element.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A heater element for a vaporizing device comprising a conductive material having a concave area of the heater element, wherein the heater element is adjacent to an ejection head having logic circuitry for jetting fluid onto the concave area of the heater element, and wherein the concave area captures and vaporizes fluid jetted from the ejection head in the vaporization device, and wherein the concave area of the heating element has a cavity volume that is at least sufficient to retain an entire volume of liquid to be vaporized.

2. The heater element of claim 1, wherein the concave area of the heater element is provided by an open-ended hexahedral-shaped heater element.

3. The heater element of claim 1, wherein the concave area of the heater element is provided by a dimpled heater element.

4. The heater element of claim 1, wherein the concave area of the heater element is provided by a conical heater element.

5. The heater element of claim 1, wherein the concave area of the heater element has a volume ranging from about 0.2 cubic centimeters (cc) to about 5.0 cc.

6. The heater element of claim 1, wherein the heater element comprises a metal selected from the group consisting of tantalum, nickel alloys, aluminum alloys, copper alloys, and tungsten.

7. A vaporization device comprising a housing body, a mouthpiece attached to the housing body, and a heater element disposed adjacent to the mouthpiece for vaporizing fluid jetted from an ejection head onto the heater element, and the ejection head having logic circuitry for jetting fluid onto the heater element, wherein the heater element comprises a conductive material having a concave area, wherein the concave area of the heater element captures and vaporizes fluid jetted from the ejection head in the vaporization device, and wherein the concave area of the heating element has a cavity volume that is at least sufficient to retain an entire volume of jetted fluid to be vaporized.

8. The vaporization device of claim 7, wherein the concave area of the heater element is provided by an open-ended hexahedral-shaped heater element.

9. The vaporization device of claim 7, wherein the concave area of the heater element is provided by a dimpled heater element.

10. The vaporization device of claim 7, wherein the concave area of the heater element is provided by a conical heater element.

11. The vaporization device of claim 7, wherein the concave area of the heater element has a volume ranging from about 0.2 cubic centimeters (cc) to about 5.0 cc.

12. The vaporization device of claim 7, wherein the heater element comprises a metal selected from the group consisting of tantalum, nickel alloys, aluminum alloys, copper alloys, and tungsten.

13. A method for vaporizing a fluid ejected by an ejection head so that substantially all of the fluid ejected by the ejection head is vaporized, comprising providing a vaporization device having the ejection head having logic circuitry for the ejection head and a vaporizing heater element adjacent to the ejection head;

jetting fluid onto the heater element using an ejection head; and activating the heater element during fluid jetting in order to vaporizes substantially all of the fluid jetted onto the heater element, wherein the heater element comprises a conductive material having a concave area, wherein the concave area of the heater element captures and vaporizes fluid jetted from the ejection head in the vaporization device, and wherein the concave area of the heating element has a cavity volume that is at least sufficient to retain an entire volume of jetted fluid to be vaporized.

14. The method of claim 13, wherein the concave area of the heater element is provided by an open-ended hexahedral-shaped heater element.

15. The method of claim 13, wherein the concave area of the heater element is provided by a dimpled heater element.

16. The method of claim 13, wherein the concave area of the heater element is provided by a conical heater element.

17. The method of claim 13, wherein the concave area of the heater element has a volume ranging from about 0.2 cubic centimeters (cc) to about 5.0 cc.

* * * * *